United States Patent [19]

Pokorny et al.

[11] Patent Number: 4,940,068

[45] Date of Patent: Jul. 10, 1990

[54] FOLDING CONTAINER

[76] Inventors: Herta M. Pokorny, 358 Castle Rd., Rochester, N.Y. 14623; Stefania Pokorny, 28 Barton Street, Rochester, N.Y. 14611

[21] Appl. No.: 355,297

[22] Filed: May 22, 1989

[51] Int. Cl.[5] ..... A45C 1/06

[52] U.S. Cl. ..... 150/132; 206/478

[58] Field of Search ..... 150/132; 206/479, 478

[56] References Cited

U.S. PATENT DOCUMENTS 1,991,306 2/1935 Woolsey ..... 206/479

4,685,570 8/1987 Medow ..... 383/95

FOREIGN PATENT DOCUMENTS 2528289 12/1983 France ..... 150/132

*Primary Examiner*—Stephen P. Garbe

*Attorney, Agent, or Firm*—Robert J. Bird

[57] ABSTRACT

A folder has separate front and back covers with imaginary fold lines between adjacent edges. The covers are apertured near their corners. An elastic tie band connects the front and back covers by interlacing sequentially through the apertures such that the folder opens by rotation of one cover relative to the other in either direction. The folding action causes the elastic tie band to surround inserted contents and hold them in place. The elastic tie band also facilitates removal of contents from the folder.

3 Claims, 1 Drawing Sheet

FOLDING CONTAINER

BACKGROUND INFORMATION

This invention relates to a folding container for holding money, coupons, loose checks and the like. Pocket sized folders are well known and widely used for wallets, notebooks, and such purposes. They consist essentially of front and back covers or panels, connected and folded at a common center line to enclose the contents. Additional panels or flaps are usually included inside one or both of the covers, these forming compartments to segregate various contents. Ordinary file folders with front and back covers folded at a common center line to enclose sheets of paper are also relevant background to this invention.

SUMMARY OF THE INVENTION

The present invention is a unique form of folder. It has separate front and back covers with parallel inner and outer edges and imaginary fold lines between adjacent edges. The covers are apertured near their corners. An elastic tie band connects the front and back covers by interlacing sequentially through the apertures such that the folder opens by rotation of one cover relative to the other in either direction. The folding action causes the elastic tie band to surround inserted contents and hold them in place. The elastic tie band also facilitates removal of contents from the folder. Mating fastening strips along top and bottom edges prevent slippage of contents from the covers and secure the folder when closed.

DETAILED DESCRIPTION

Figure 1:
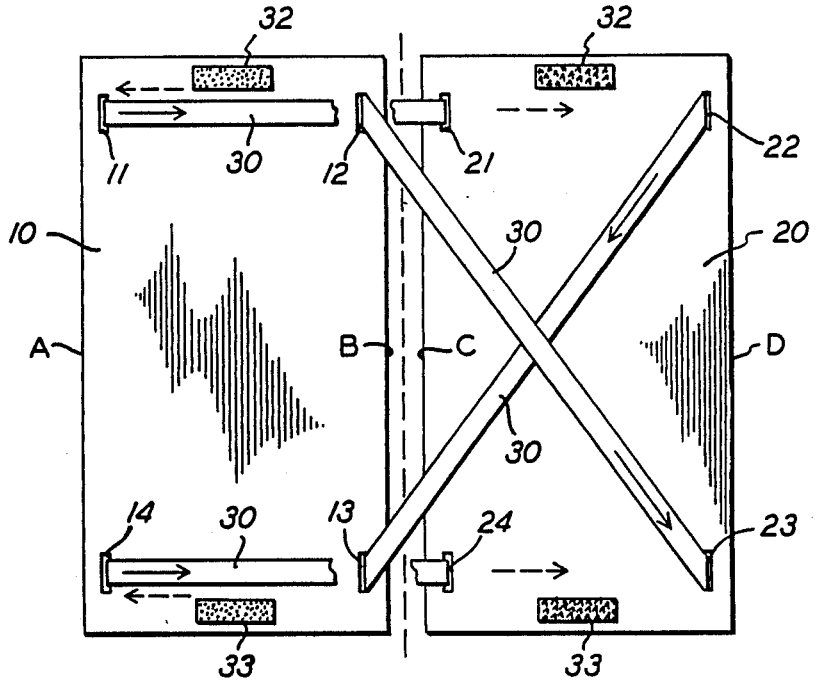
FIG. 1 is a plan view of an open folder according to this invention.
Figure 2:
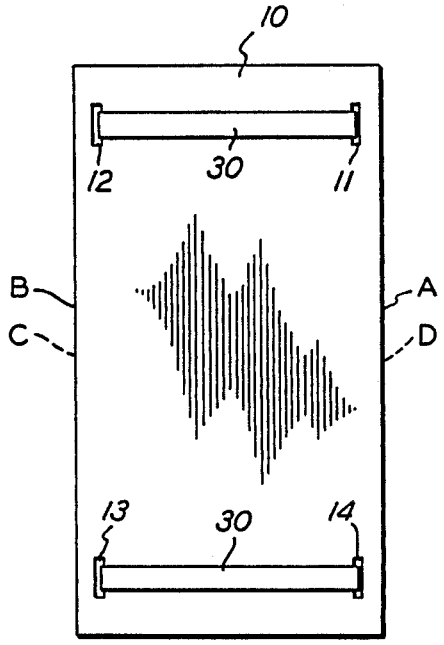
FIG. 2 is a plan view of the folder of this invention in a closed position.

The folder of this invention is not limited as to size or geometric configuration. For purposes of illustration and discussion, however, consider the folder as the size of a vest pocket wallet. Referring now to FIG. 1, the folder of this invention includes a flat rectangular front cover or panel 10 and a similar back cover or panel 20, separate from the cover 10. In the embodiment shown, the covers 10 and 20 are simply flat pieces with no additional panels, pockets, or flaps on either surface. The front cover 10 has an outer edge A and a parallel inner edge B. The back cover 20 has an inner edge C and a parallel outer edge D. The phantom line BC represents an imaginary center line or fold line between the inner edges B and C of the front and back covers respectively. The phantom line DA represents an imaginary center line or fold line between the outer edges D and A of the back and front covers respectively, FIG. 2 shows the folder closed, with the front cover 10 overlying the back cover.

Referring again to FIG. 1, the front and back covers 10 and 20 each include four apertures, generally near their corners. The front cover 10 includes outer apertures 11 and 14, and inner apertures 12 and 13. The back cover 20 includes inner apertures 21 and 24, and outer apertures 22 and 23.

An elastic tie band 30 is interlaced through the several apertures to connect the front and back covers 10 and 20. The lacing pattern of the tie band 30 is as follows, starting from the under side of aperture 11:

a. up through aperture 11 and across the front cover 10 to aperture 21;
b. down through aperture 21 and under the back cover 20 to aperture 22;
c. up through aperture 22 and across the back cover 20 to aperture 13;
d. down through aperture 13 and under the front cover 20 to aperture 14;
e. up through aperture 14 and across the front cover 10 to aperture 24;
f. down through aperture 24 and under the back cover 20 to aperture 23;
g. up through aperture 23 and across the back cover 20 to aperture 12;
h. down through aperture 12 and under the front cover 20 to the point of beginning, where the band is connected in a closed loop. The arrows help to follow the lacing pattern; they are in the drawing for that purpose only. Solid arrows indicate visible sections of the tie band 30. Phantom arrows indicate sections of tie band 30 invisible behind a cover panel.

The folder, with its front and back covers connected in this way, has interesting mechanical properties. From a closed position (FIG. 2), the folder can be opened in either direction. The front cover 10 can be opened either to the left (about the imaginary fold line BC) or to the right (about the imaginary fold line DA). The folder opened to the left is represented by the front and back covers in solid lines in FIG. 1. The folder is thus "double acting". In addition, the folding action causes the elastic tie band to surround inserted contents and hold them in place. Consider the folder lying open, as in the solid line condition of FIG. 1. A dollar bill is simply placed on either cover (not tucked under the elastic bands). One cover is then closed over the other. Another turn of the same cover in the same direction opens the folder to reveal the dollar bill now safely tucked in behind sections of the tie band. Further opening and closing does not reverse this action, and the bill remains in place until purposely removed. The elastic tie band facilitates such removal.

In any of the folder positions, open or closed, the elastic tie band 30 is snug against the covers, and holds their contents in place against the inner walls of the covers. The elasticity of the tie band also facilitates the removal of bills and such articles from the folder.

The inside of the covers 10 and 20 include mating fastener strips 32 at the top, and 33 at the bottom. Velcro is a trademark for a material commonly used for similar purposes. In the folder of this invention, the fastener strips 32 and 33 serve two purposes. When the folder is closed, the strips hold it closed, and whether the folder is open or closed, the strips prevent vertical slippage of contents from the covers.

The tie band 30, as shown and described, is a single piece interlaced and joined at its ends forming a closed loop. The same result is also achieved by two tie bands. As an example, one band is threaded sequentially at points 11, 21, 22, 13, and back to 11, and the other is threaded at points 14, 24, 23, 12, and back to 14. Also, the bands need not be closed loops. With reference to the interlacing illustrated in FIG. 1 and described in detail in steps a–h above, the equivalent result is obtained if the ends (between apertures 11 and 12) are not connected, i.e. the loop not closed.

The material of the covers is not an essential part of this invention. It is important only that the folder have enough body to support itself and its contents. Leather and plastic are examples of materials likely to be used.

The foregoing description of a preferred embodiment of this invention is intended as illustrative. The concept and scope of the invention are limited only by the following claims and equivalents thereof.

What is claimed is:

1. A folder, including:

front and back rectangular covers, each having parallel top and bottom end edges and parallel inner and outer side edges, with an imaginary fold line between a side edge of said front cover and the adjacent side edge of said back cover;

said covers including inner apertures near the inner corners thereof and outer apertures near the outer corners thereof;

an elastic tie band connecting said front and back covers by interlacing sequentially through said apertures as follows:

a. from an outer aperture of said front cover,
b. to an inner aperture of said back cover,
c. to an outer aperture of said back cover,
d. to an inner aperture of said front cover,
e. to an outer aperture of said front cover,
f. to an inner aperture of said back cover,
g. to an outer aperture of said back cover, and
h. to an inner aperture of said front cover;

whereby, said elastic tie band overlies said covers to hold their contents in place and to facilitate insertion and removal of contents into and out of said folder, and said folder opens by rotation of one cover relative to the other on an imaginary fold line in either direction;

said covers further including mating top fastening strips positioned adjacent to and parallel with said top end edges and adapted to fasten to each other, and mating bottom fastening strips positioned adjacent to and parallel with said bottom end edges and adapted to fasten to each other said fastening strips effective to prevent slippage of contents from the top and bottom ends of said folder and to secure said folder when closed.

2. A folder as defined in claim 1, said tie band further extending as follows:

i. to the point of beginning where said band is connected in a closed loop.

3. A folder, including:

front and back rectangular covers, each having parallel top and bottom end edges and parallel inner and outer side edges, with an imaginary fold line between a side edge of said front cover and the adjacent side edge of said back cover;

said covers including inner apertures near the inner corners thereof and outer apertures near the outer corners thereof:

a first eleastic tie band interlaced through said apertures to connect said front and back covers, said first tie band extending sequentially as follows:

a. from a first outer aperture of said front cover,
b. to a first inner aperture of said back cover,
c. to a first outer aperture of said back cover, and
d. to a first inner aperture of said front cover, a second elastic tie band interlaced through said apertures to connect said front and back covers, said second tie band extending sequentially as follows:

e. from a second outer aperture of said front cover,
f. to a second inner aperture of said back cover,
g. to a second outer aperture of said back cover, and
h. to a second inner aperture of said front cover:

whereby, said elastic tie bands overlie said covers to hold their contents in place and to facilitate insertion and removal of contents into and out of said folder, and said folder opens by rotation of one cover relative to the other on an imaginary fold line in either direction:

said covers further including mating top fastening strips positioned adjacent to and parallel with said top end edges and adapted to fasten to each other, and mating bottom fastening strips positioned adjacent to and parallel with said bottom end edges and adapted to fasten to each other said fastening strips effective to prevent slippage of contents from the top and bottom ends of said folder and to secure said folder when closed.

* * * * *